United States Patent [19]

Lancella

[11] Patent Number: 4,840,588

[45] Date of Patent: Jun. 20, 1989

[54] SOCKET CONTACT FOR CONTACT DEVICES OF THE PIN AND SOCKET TYPE

[75] Inventor: Attilio Lancella, Genova-Sestri, Italy

[73] Assignee: Connei S.p.A., Italy

[21] Appl. No.: 164,906

[22] Filed: Mar. 7, 1988

[30] Foreign Application Priority Data

Mar. 25, 1987 [IT] Italy ..... 12447 A/87

[51] Int. Cl.[4] ..... H01R 13/54

[52] U.S. Cl. ..... 439/851

[58] Field of Search ..... 439/851

[56] References Cited

U.S. PATENT DOCUMENTS 3,314,044 4/1967 Powell ..... 439/851

4,447,108 5/1984 Ghigliotti et al. ..... 439/851

FOREIGN PATENT DOCUMENTS 0110194 7/1928 Austria ..... 439/851

*Primary Examiner*—Joseph H. McGlynn

*Attorney, Agent, or Firm*—Larson and Taylor

[57] ABSTRACT

The socket contact is of the type which, when the pin contact is not inserted, the areas of the socket contact intended to establish the contact with the pin contact (6) are arranged at least approximately according to a family of straight generatrices of a hyperboloid of revolution of one branch. The socket contact is obtained by means of permanent deformation by twisting through a predetermined angle of a cylindrical sleeve (1) of suitable metal, after having obtained, on the said sleeve, a plurality of slots (2) arranged equispaced on its cylindrical surface. The slots (2) present a lanceolate shape, with base (102) directed towards the annular zone (5) of the inlet end of the sleeve (1), while the apex (202) is directed towards the rear section of the sleeve (1). In such a manner, as a consequence of the twisting, the zone of maximum reduction of the sleeve, and consequently the zone of initial contact between sleeve (1) and pin contact (2) comes to be located in proximity of the inlet ring zone (5) of the sleeve itself.

6 Claims, 1 Drawing Sheet

SOCKET CONTACT FOR CONTACT DEVICES OF THE PIN AND SOCKET TYPE

BACKGROUND AND SUMMARY OF THE INVENTION

The present invention has for its object a socket contact for electrical contact devices, of the pin and socket type.

More precisely, the socket contact member of the invention is of the type in which, when the pin contact is not inserted, the areas of the socket contact intended to establish the contact with the pin contact are arranged at least approximately according to a family of straight generatrices of a hyperboloid of revolution of one branch. Said socket contact is achieved by means of permanent deformation by twisting according to a predetermined angle of a cylindrical hollow body or sleeve of suitable metal, provided with through slots arranged along its cylindrical surface and inclined with respect to the longitudinal axis of said cylindrical body, said twisting being directed in the sense of inclination of the slots. A socket contact of such type is disclosed for example in U.S. Pat. No. 4,447,108 in the name of the same inventor.

In socket contacts of that type there arises the problem (both due to standard rules and to functional requirements of the contact of obtaining the result that the electric contact between the socket and the pin does not take place beyond a predetermined length of insertion of the pin contact itself inside the bore of the socket contact. According to U.S. Pat. No. 4,447,108, said problem is solved by obtaining a zone of smaller thickness in the cylindrical sleeve which constitutes the socket contact and thus varying consequently the positioning of the zone of greatest reduction along the sleeve itself. More particularly said variation of the thickness is obtained by forming the sleeve in such a manner that it presents an outer conicity directed towards the inlet of the said sleeve. This prior solution of the problem, although satisfactory, presents some difficulties due to the necessity of obtaining an outer conicity of the sleeve, particularly in the case of reduced dimensions of the sleeve itself.

According to the present invention, the problem of the positioning of the zone of maximum reduction of the socket contact in proximity of the inlet of the socket contact itself is solved by providing, in a socket contact of the type above specified, a plurality of slots characterized by the fact that each has a lance-head or lanceolate shape, in which the bases of each slot are arranged in proximity to the annular inlet zone of the socket contact.

BRIEF DESCRIPTION OF THE DRAWINGS

The above and other features of the socket contact member of the present invention, and the advantages deriving therefrom, will appear evident from the following description, made by way of non-limiting example, of a preferred embodiment, with reference to the figures of the attached drawings, in which.

DESCRIPTION OF THE PREFERRED EMBODIMENT

Figure 1:
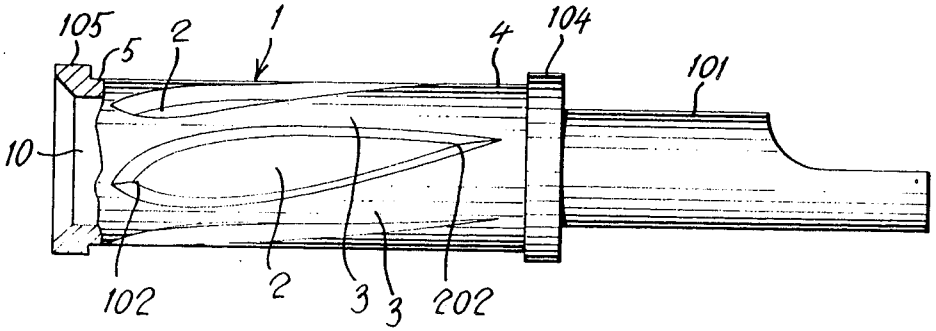
FIG. 1 is a side view, with parts in section, of a socket contact provided with slots according to the invention, prior to the twisting operation.
Figure 2:
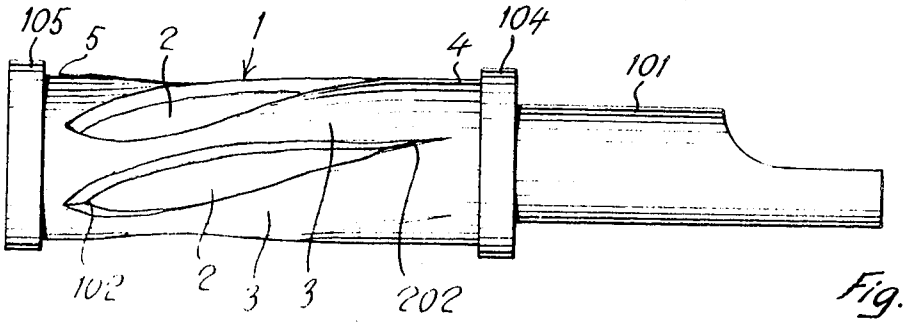
FIG. 2 is a side view of the socket contact of FIG. 1, after the twisting operation.

With reference to FIG. 1, there is shown a socket contact intended to be the female element in an electric contact device. Said socket contact is of the type disclosed for example in the U.S. Pat. No. 4,447,108 in the name of the same inventor, and it is normally made starting from a solid bar machined by a machine tool. More precisely, in said bar there is provided a bore 10 suitably flared out at its inlet, so as to define a rectangular circular cylindrical sleeve 1 closed at one base or end. In correspondence with the base ends of the cylindrical sleeve which define annular zones or "rings" 4 and 5, there can be optionally obtained, by machining, two annular projections 104 and 105. The socket contact is completed by a hollow appendix 101 serving for the connection (in a known manner) with the terminals of an electrical cable (not shown). Obviously, the shape and size of said connection appendix for the connection with the electric circuit can vary in any known manner which can be easily conceived by a person skilled in the art, depending upon the required connection. The socket contact member is made of any suitable metal or metal alloy for electric conduction. It must be noted that the socket member according to the present invention may consist only of the cylindrical body of sleeve 1, without the appendix 101 and without the annular projections 104 and 105, as described in another application filed on this same date in the name of the same applicant.

On the cylindrical wall of the sleeve wall there are obtained a plurality of slots 2 arranged along the whole circumference, preferably equispaced. Said slots may be obtained in any suitable manner, for example by machining, with the aid of a double-angle milling cutter (not shown). As it appears from the figures, said slots 2 are inclined with respect to the longitudinal axis of sleeve 1 and define between each other a plurality of strips 3 which are inclined with respect to the longitudinal axis of sleeve 1 of the same inclination angle.

Figure 3:
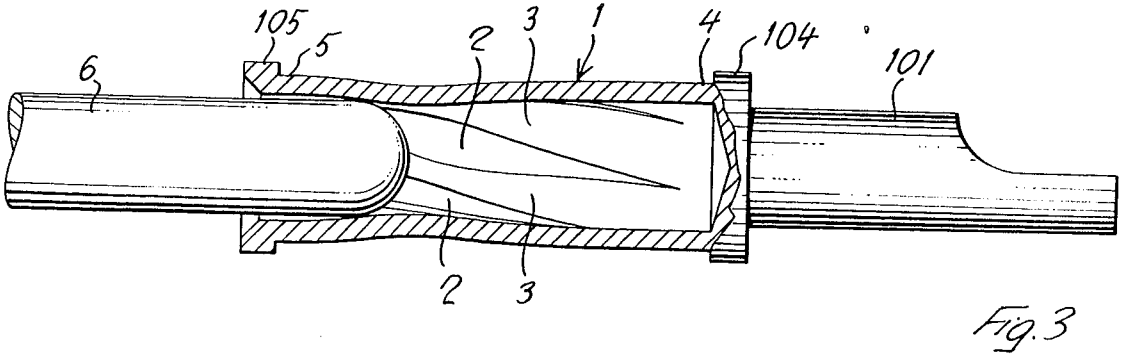
FIG. 3 is a side view, with parts in section, of the socket contact subsequently to being subjected to twisting, and showing the pin contact while being inserted.

The slots 2 are characterized by the fact that they present a lance-head or lanceolate shape, with the apex 202 and the base 102 which are both pointed, i.e. with a sharp edge. More particularly, the bases 102 of each slot 2 terminate in the zone of the inlet ring 5 of the sleeve 1. In this manner, each strip 3 defined between two slots 2 does not present a uniform width, but it presents a region of smaller width in proximity of the inlet ring 5. Said smaller width of the strip leads to a consequent weakening of the strip itself in said zone, so that, following the twisting imparted to the sleeve itself, by effecting a relative rotation according to a predetermined angle between the two end rings 4 and 5, there will be obtained a deformation of the strips 3 whereby same will tend to arrange themselves at least approximately according to a family of generatrices of a hyperboloid of one branch, in such a manner that the zone of progressive maximum reduction of the sleeve will be located in proximity of the inlet ring 5 of the sleeve 1 itself. As it was stated above, said feature is particularly advantageous in the case that it is required (either due to standard rules or to functional requirements of the contact) that the electric contact between the socket 1 and the pin 6 (see particularly FIG. 3) takes place not beyond a predetermined length of insertion of the pin 6 into the bore of the socket.

It is evident that by modifying the shape and/or the zone of maximum width of each lanceolate slot 2, and consequently the shape of each strip 3 defined between two slots 2, it will be possible to modify the positioning of the point of maximum reduction of sleeve 1, with corresponding variation of the initial contact point between the pin contact 6 and the interior of sleeve 1.

The sleeve according to the present invention can be also obtained by means of coinage operation, starting from a solid bar, which is subsequently subjected to axial boring.

The sleeve 1 according to the present invention can be moreover obtained, in a known manner, starting from punched metal sheets, or also starting from a continuous pipe.

It is therefore to be understood that the invention is not limited to the embodiment which has been above described and illustrated merely by way of example, and that many variations and modifications are possible, without however departing from the limits of the inventive idea as above described and claimed hereinafter.

I claim:

1. A socekt contact for contact devices of the socket and pin type, in which, when the pin contact is not inserted, the areas of the socket contact which establish contact with the pin contact, upon insertion of same, are arranged at least approximately according to a family of straight generatrices of a hyperboloid of revolution of one branch, said socket contact having been formed by means of deformation by twisting through a predetermined angle of a hollow cylindrical sleeve of suitable metal, provided with through slots arranged along its cylindrical surface and inclined with respect to the longitudinal axis of said sleeve, said twisting being directed in the sense of inclination of the slots, wherein:

each slot is so shaped that prior to twisting deformation, it has a lance-head or lanceolate shape, the base of the slot being near the zone of maximum width of the slot and the apex of the slot terminating at the zone of the least width of the slot, the bases of the slots being arranged in proximity to the annular inlet zone of the sleeve.

2. A socket contact according to claim 1, wherein both the base and the apex of each lanceolate slot terminates with sharp edges.

3. A socket contact according to claim 1, wherein each socket contact is formed from a solid bar which is bored out and has then had the slots formed by a milling cutter.

4. A socket contact according to claim 1, wherein the socket contact is formed from a solid bar which has been longitudinally bored to form a sleeve, and wherein the slots have been formed in the sleeve by coinage operations.

5. A socket contact according to claim 1, wherein the sleeve is formed from a metal sheet which has been punched and subsequently shaped by bending.

6. A socket contact according to claim 5, wherein the slots have been formed by punching of the metal sheet.

* * * * *